313-422 SR
2/16/82 OR 4,316,118

United States Patent [19]
Anderson et al.
[11] 4,316,118
[45] Feb. 16, 1982

[54] GUIDED BEAM DISPLAY DEVICE

[75] Inventors: Charles H. Anderson, Rocky Hill; Thomas L. Credelle, East Windsor; Wieslaw W. Siekanowicz, Lawrenceville, all of N.J.

[73] Assignee: RCA Corporation, New York, N.Y.

[21] Appl. No.: 921,267

[22] Filed: Jul. 3, 1978

[51] Int. Cl.[3] ..... H01J 29/56
[52] U.S. Cl. ..... 313/422
[58] Field of Search ..... 313/422

[56] References Cited

U.S. PATENT DOCUMENTS 2,225,901 12/1940 Bruche ..... 313/460
4,031,427 6/1977 Stanley ..... 313/422
4,088,920 5/1978 Siekanowicz et al. ..... 313/422
4,121,130 10/1978 Gange ..... 313/409
4,128,784 12/1978 Anderson ..... 313/422

*Primary Examiner*—Robert Segal
*Attorney, Agent, or Firm*—Eugene M. Whitacre; Glenn H. Bruestle

[57] ABSTRACT

An evacuated envelope having a front wall encloses a plurality of electron beam guides. Extending across one end of the beam guides is a line cathode which generates a plurality of electron beams and directs the beams into the guides. A pair of parallel modulation electrodes is associated with each beam guide and is positioned with the cathode between them. Each modulation electrode partially overlaps the associated electron beam guide. A cathodoluminescent screen is on the front wall.

3 Claims, 5 Drawing Figures

GUIDED BEAM DISPLAY DEVICE

BACKGROUND OF THE INVENTION

The present invention relates to a flat panel display device having electron beam guides and particularly to such a display device in which the beam guides include means for modulating the electron beams.

U.S. Pat. No. 4,031,427 to T. O. Stanley, issued June 21, 1977, entitled "Flat Cathode Ray Tube" describes a flat, cathodoluminescent display device which includes in an evacuated envelope beam guides extending along the back wall of the envelope from a gun structure which generates electrons and directs the electrons as beams into the beam guides. The beam guides confine the electrons in the beams as the beams travel along paths parallel to the front wall of the envelope and selectively deflect the beams toward a phosphor screen on the front wall at selected points along the paths of the beams.

U.S. Pat. No. 4,088,920 to W. W. Siekanowicz et al., issued May 9, 1978, entitled "Flat Display Device with Beam Guide" describes a beam guide for use in the display device of the type described in U.S. Pat. No. 4,031,427. The beam guide includes a pair of spaced, parallel plates extending along and spaced from the back wall of the envelope. The plates have a plurality of aligned openings therethrough with the openings being arranged in rows extending longitudinally along the paths of the beams. Each longitudinal row of the openings constitutes a separate beam guide.

Copending applicatons for U.S. patent, Ser. No. 784,365 of R. A. Gange, filed Apr. 4, 1977, entitled "Cathode Structure and Method of Operating the Same" and Ser. No. 835,772 of C. H. Anderson, filed Sept. 22, 1977, entitled "Beam Guide for Display Device with Beam Injection Means", disclose gun structures for use in the display device of the type described in U.S. Pat. No. 4,031,427. The gun structures include a line cathode having modulation or control electrodes spaced along the line cathode. Potentials applied to the modulation electrodes cause the electrons generated by the cathode to be emitted therefrom in the form of beams. The gun structures may include isolation electrodes between the modulation electrodes to assist in confining the electrons in the beams emitted from the gun structure and guiding the beams into the guide structure.

In the gun structure of the Anderson application, Ser. No. 835,772, the modulation electrodes must be accurately dimensioned and positioned with respect to the electron guides. If the edges of the two overlapping modulation electrodes which face the guides do not have a similar contour and are not equidistant from the guide, the beam will be pulled off center and will not enter the guide properly. Therefore, during the fabrication of the display device, the modulation electrodes must be positioned with a high degree of tolerance.

SUMMARY OF THE INVENTION

A display device includes an evacuated envelope with substantially parallel front and back walls. Within the envelope is a line cathode and an electron beam guide which controls the flow of electrons from the cathode. A pair of parallel modulation electrodes are spaced apart with the line cathode therebetween. Each of the modulaton electrodes partially overlaps the beam guide. A cathodoluminescent screen is on the front wall of the envelope.

DETAILED DESCRIPTION OF THE PREFERRED EMBODIMENT

Figure 1:
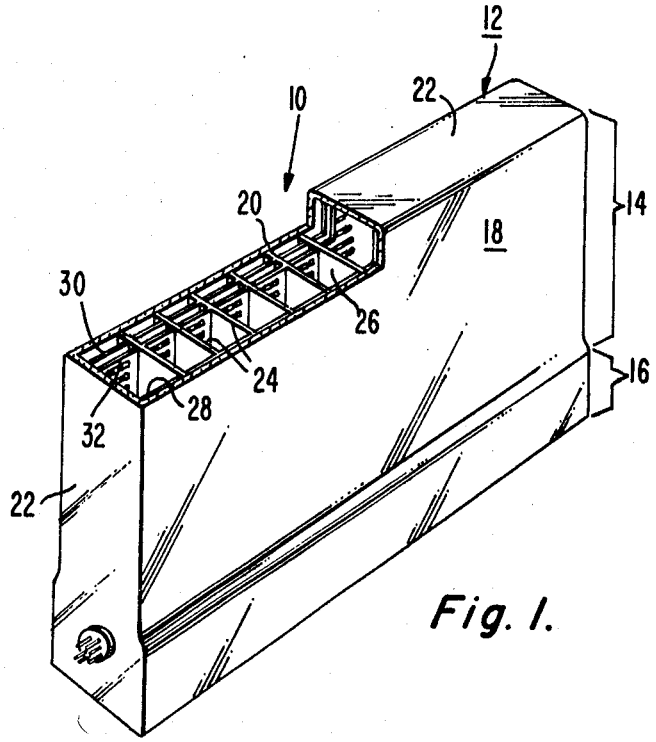
FIG. 1 is a perspective view, partially broken away, of one form of the novel display device.

Referring to FIG. 1, one form of a flat display device of the present invention is generally designated as 10. The display device 10 comprises an evacuated envelope 12, typically of glass, having a display section 14 and an electron gun section 16. The envelope 12 includes a rectangular front wall 18 and a rectangular back wall 20 in spaced parallel relation with the front wall 18. The front wall 18 and the back wall 20 are connected by four side walls 22.

A plurality of spaced, parallel support walls 24 are secured between the front wall 18 and the back wall 20 and extend from the gun section 16 to the opposite side wall 22. The support walls 24 provide the desired internal support against external atmospheric pressure and divide the display section 14 into a plurality of channels 26. On the inner surface of the front wall 18 is a screen 28 composed of cathodoluminescent elements which may be of any well known type presently used in cathode ray tubes. In a color display, for example, the phosphor screen in each of the channels 26 alternate between red, green and blue light emitting phosphor strips or elements.

Figure 2:
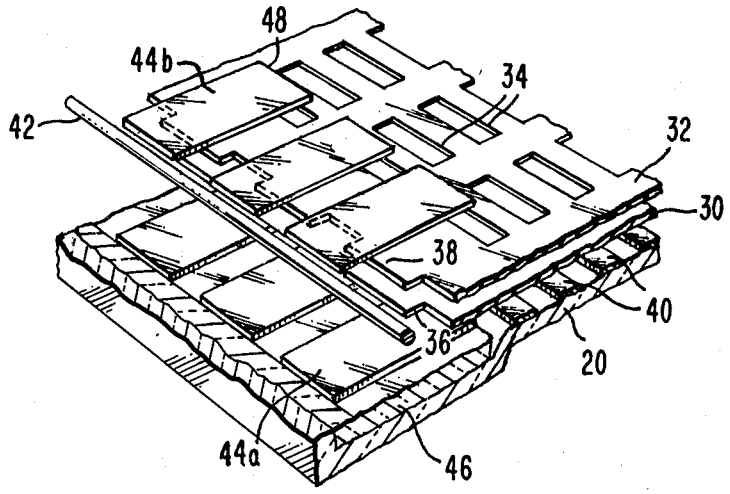
FIG. 2 is a perspective view of a portion of the beam guide and gun structure of the display device of FIG. 1.

In each of the channels 26 is a beam guide assembly of the type described in the previously referred to U.S. Pat. No. 4,088,920, issued May 9, 1978. As shown in FIG. 2, each of the beam guide assemblies includes a pair of spaced, parallel beam guide plates 30 and 32 extending transversely across the channel 26 and longitudinally along the channel from the gun section 16 to the opposite side wall 22. The first beam guide plate 30 is adjacent and parallel to the back wall 20 of the envelope 12 and the second beam guide plate 32 is between the first beam guide plate 30 and the front wall 18. The second beam guide plate 32 has a plurality of openings 34 therethrough, with the openings being arranged in rows transversely across and longitudinally along the channel 26. The first beam guide plate 30 has similar openings therethrough (not shown) with each of the openings in the first beam guide plate 30 being in alignment with a separate opening 34 in the second beam guide plate 32. Each pair of longitudinal rows of the openings in the beam guide plates form a separate electron beam guide along the channel 26.

The beam guide plates 30 and 32 have a plurality of tabs 36 and 38, respectively, projecting from their ends which are adjacent the gun section 16. Each of the tabs 36 and 38 is in alignment with a separate longitudinal row of the openings in the respective guide plate 30 and 32, and is of a dimension transversely across the channel 26 less then the corresponding dimension of the openings in the guide plates. Each of the tabs 38 is in opposed overlapping relation with a separate tab 36.

A plurality of spaced, parallel conductors 40 are on the back wall 20. The conductors 40 extend transversely across the channels 26 with each conductor 40 extending along a separate transverse row of the openings in the beam guide plates 30 and 32. The conductors 40 are strips of an electrically conductive metal coated on or bonded to the back wall 20.

In the gun section 16 of the envelop 12 is a gun structure of the type shown and described in the previously referred to copending application, Ser. No. 784,365. As shown in FIG. 2, this gun structure includes a line cathode 42 of a filament of a metal which will withstand high temperatures, such as tungsten, coated with an emissive material, such as an emissive oxide. One suitable emissive oxide is formed from a mixture of about 13% calcium carbonate, 31% strontium carbonate and 56% barium carbonate which is heated to convert the carbonates to the oxides. The cathode 42 extends transversely across the end of at least one of the channels 26 and is positioned in a plane which is parallel and between the planes of the beam guide plates 30 and 32. The cathode 42 is held under tension, such as by springs (not shown) at the ends of the cathode. There may be a single cathode across each of the channels 26, across several of the channels 26 or a single cathode across all of the channels.

Figure 3:
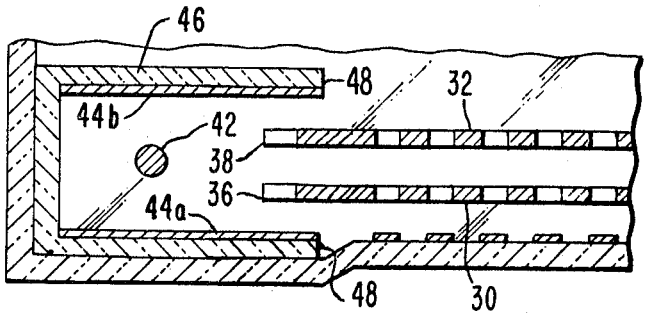
FIG. 3 is a sectional view through a portion of the beam guide and gun structure.

A plurality of pairs of modulation or control electrodes 44*a* and 44*b* are spaced along the cathode 42 with the cathode extending between the electrodes of each pair. The modulation electrodes 44*a* and 44*b* of each pair are in an over-lapping parallel relation to each other and to the beam guide plates 30 and 32. As shown in the copending application, Ser. No. 784,365, the modulation electrodes, 44*a* and 44*b* may be mounted on the walls 46 of a u-shaped support which opens toward the beam guide plates 30 and 32. A portion of each modulation electrode 44*a* and 44*b* overlaps a portion of the beam guide. Specifically, the edge 48 of the first modulation electrode 44*a* which is nearest the beam guide assembly, extends under the edge of the first guide grid 30, and the edge 48 of the second electrode 44*b* extends over the edge of the second guide grid 32 in the orientation of FIGS. 2 and 3. The modulation electrodes 44*a* and 44*b* do not extend over the apertures 34 in the guide grids 30 and 32.

In the operation of the display device 10 a high positive potential, typically about +300 volts, is applied to each of the conductors 40, and a low positive potential typically about +40 volts, is applied to the beam guide plates 30 and 32. A very high positive potential, typically about 8-10 kV is applied to the phosphor screen 28. These potentials are with regard to the potential applied to the cathode 42. As described in U.S. Pat. No. 4,088,920 issued May 9, 1978, the potential differences between the beam guide plate 30 and the conductors 40 and between the beam guide plate 32 and the phosphor screen 28 create electrostatic fields which extend into the space between the beam guide plates 30 and 32 and confine electrons to beams flowing between the beam guide plates along each of the longitudinal rows of the openings. The beams of electrons can be selectively deflected toward the phosphor screen 28 at selected points along the channels 26 by switching the potential applied to each of the conductors 40 to a negative potential, such as −300 volts. This will cause the beams to be deflected away from the negative conductor so that the beams will pass through the adjacent openings 34 in the beam guide plate 32. The beams will then impinge on the phosphor screen 28 to provide a line scan of the phosphor screen.

The electron beams are generated in the gun section 16 by heating the cathode to its emission temperature, typically about 760° C., to cause the cathode to emit electrons. With the potential applied to the modulation electrodes 44*a* and 44 *b* sufficiently negative with respect to the potential applied to the cathode 42, typically about 70 volts more negative, the electrons emitted from the cathode will be trapped within the gun structure. When the potential applied to any pair of the modulation electrodes 44*a* and 44*b* is switched to a more positive potential, typically, no more positive than about −10 volts, the electrons in the region of such modulation electrodes will flow toward the positively charged beam guide plates 30 and 32 in the form of a beam. The tabs 36 and 38 which are adjacent these less negative modulation electrodes are at the same positive potential as the beam guide plates. The fields generated around these tabs penetrate toward the gun structure to create an acceleration field which draws the electrons between the guide plates along the longitudinal row of the guide plate openings. Thus, each pair of the tabs 36 and 38 serve to accurately guide a beam of electrons emitted from the gun structure between the beam guide plates 30 and 32 along a longitudinal row of the openings in the beam guide plates.

By making the modulation electrodes 44*a* and 44*b* of a dimension longitudinally along the cathode 42 greater than the corresponding, i.e. transverse, dimension of the beam, the edges of the modulation electrodes between adjacent electrodes play a negligible role in where the beam is formed so that the modulation electrodes 44*a* and 44*b* need not be aligned with great precision with respect to the longitudinal rows of the openings in the beam guide plates. In the display device of the present invention the tabs 36 and 38 are the critical part since they determine where the electrons leave the cathode and enter into the beam guides. Thus, the tabs must be aligned with the openings in the beam guides with great precision. However, since the tabs 36 and 38 are an integral part of the beam guide plates 30 and 32, they can be easily formed at the same time and by the same process as the openings are formed so that great precision of the position of the tabs with respect to the openings can be easily achieved. Thus, the display device of the present invention achieves accuracy of the injection of the electron beams into the beam guides from the gun structure with a structure which is relatively simple and easy to make and assemble.

In the present invention, the edges 48 of the modulation electrodes 44*a* and 44*b* partially overlap the beam guide grids 30 and 32. This overlap eliminates the deleterious effects of differences in the contour or misalignment of the edges 48 of a pair of overlapping electrodes. The non-symmetrical electrical fields caused by the modulation electrode misalignment do not substantially affect the electron beam injection into the beam guide assembly. Furthermore, the extension of the modulation electrodes so that they partially overlap the guide grids does not appreciably affect the balance of electrical fields within the electron beam guide.

Figure 4:
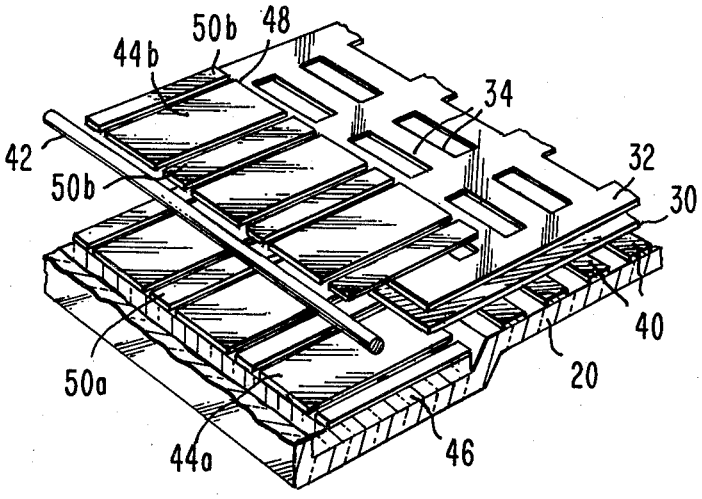
FIG. 4 is a perspective view similar to FIG. 2 but of a different embodiment.

As shown in FIG. 4, isolation electrodes 50*a* and 50*b* may be between adjacent modulation electrodes 44*a* and 44*b* respectively. The isolation electrodes 50*a* and 50*b* also extend over the edges of the guide grids 30 and 32. The guide grids 30 and 32 do not have the tabs 36 and 38 of the embodiment in FIG. 2. By negatively biasing the isolation electrodes 50*a* and 50*b*, the electron beam from the cathode 42 will be prevented from excessively spreading laterally (i.e., along the axis of the cathode). The isolation electrodes 50*a* and 50*b* are functional substitutes for the tabs 36 and 38 in the previous embodiment.

Figure 5:
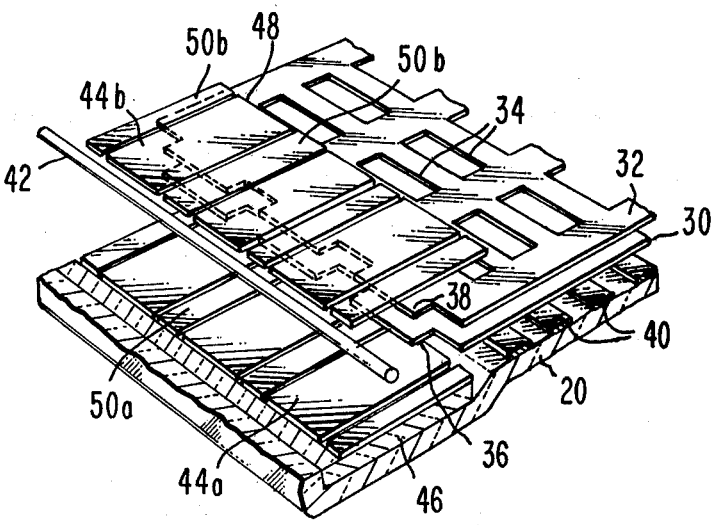
FIG. 5 is a perspective view similar to FIG. 4 but of a second different embodiment.

FIG. 5 shows the use of tabs 36 and 38 and isolation electrodes 50*a* and 50*b*. As previously discussed, each pair of tabs 36 and 38 serve to accurately guide a beam of electrons emitted from the cathode 42 between the beam guide plates 30 and 32 along a longitudinal row of openings in the beam guide plates. The negatively biased isolation electrodes 50*a* and 50*b* prevent the electron beam from excessively spreading laterally before entering the acceleration field created around tabs 36 and 38.

What is claimed is:

1. In a display device having an evacuated envelope with substantially parallel front and back walls, an electron beam guide, a line cathode extending across one end of the electron beam guide, and a cathodoluminescent screen on the front wall; the improvement comprising:

a pair of parallel modulation electrodes positioned with said line cathode extending therebetween, each of said modulation electrodes partially overlapping said beam guide.

2. The device as in claim 1 wherein said beam guide comprises two parallel guide grids, which extend between said pair of modulation electrodes.

3. The device as in claim 1 further comprising a pair of isolation electrodes on each side of said modulation electrodes, said isolation electrodes partially overlapping said beam guide.

* * * * *